US008336802B2

(12) United States Patent
Matthies et al.

(10) Patent No.: US 8,336,802 B2
(45) Date of Patent: Dec. 25, 2012

(54) BOBBIN HOLDER

(75) Inventors: Claus Matthies, Wasbek (DE); Jan Westphal, Schuelp (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 13/348,344

(22) Filed: Jan. 11, 2012

(65) Prior Publication Data

US 2012/0145819 A1 Jun. 14, 2012

Related U.S. Application Data

(63) Continuation of application No. PCT/EP2010/059347, filed on Jul. 1, 2010.

(30) Foreign Application Priority Data

Jul. 15, 2009 (DE) ..... 10 2009 033 099

(51) Int. Cl.
*B65H 65/00* (2006.01)

(52) U.S. Cl. ..... 242/476.5

(58) Field of Classification Search ..... 242/474.7, 242/475, 476.1, 476.2, 476.4, 476.5, 476.6, 242/579, 586, 586.2, 587, 587.2, 125–125.3
See application file for complete search history.

(56) References Cited

U.S. PATENT DOCUMENTS

| | | | | |
|---|---|---|---|---|
| 3,801,038 | A * | 4/1974 | Wust | 242/487.6 |
| 4,413,791 | A | 11/1983 | Kawaguchi et al. | |
| 4,477,034 | A * | 10/1984 | Oswald | 242/476.6 |
| 4,482,099 | A * | 11/1984 | Oswald et al. | 242/487.6 |

FOREIGN PATENT DOCUMENTS

| | | | |
|---|---|---|---|
| DE | 2344377 | A1 | 3/1974 |
| DE | 3235991 | A1 | 4/1983 |
| DE | 8715906 | U1 | 1/1988 |
| DE | 9301313 | U1 | 3/1993 |
| DE | 10235209 | C1 | 12/2003 |
| DE | 10333273 | A1 | 2/2005 |
| WO | 2007073860 | A1 | 7/2007 |

* cited by examiner

*Primary Examiner* — William E Dondero
(74) *Attorney, Agent, or Firm* — BainwoodHuang

(57) ABSTRACT

The improvement relates to a bottom holder for winding up a thread, wherein a bobbin case can be slid onto a protruding bobbin spindle. In order to catch and clamp a thread on the circumference of the bobbin spindle at the beginning of a bobbin travel, a thread catching device and a thread clamping means are provided at a free insertion end of the bobbin spindle. In order to both securely clamp and automatically release the thread end when sliding off a bobbin, according to the improvement, the clamping means is formed by a hollow cylindrical clamping bushing, an outer cone thereof being fitted into an inner diameter bounded by catches, such that a clamping slit substantially axially oriented and open toward the insertion end of the bobbin spindle is formed between the clamping bushing and the catch.

9 Claims, 6 Drawing Sheets

BOBBIN HOLDER

Figure 1:
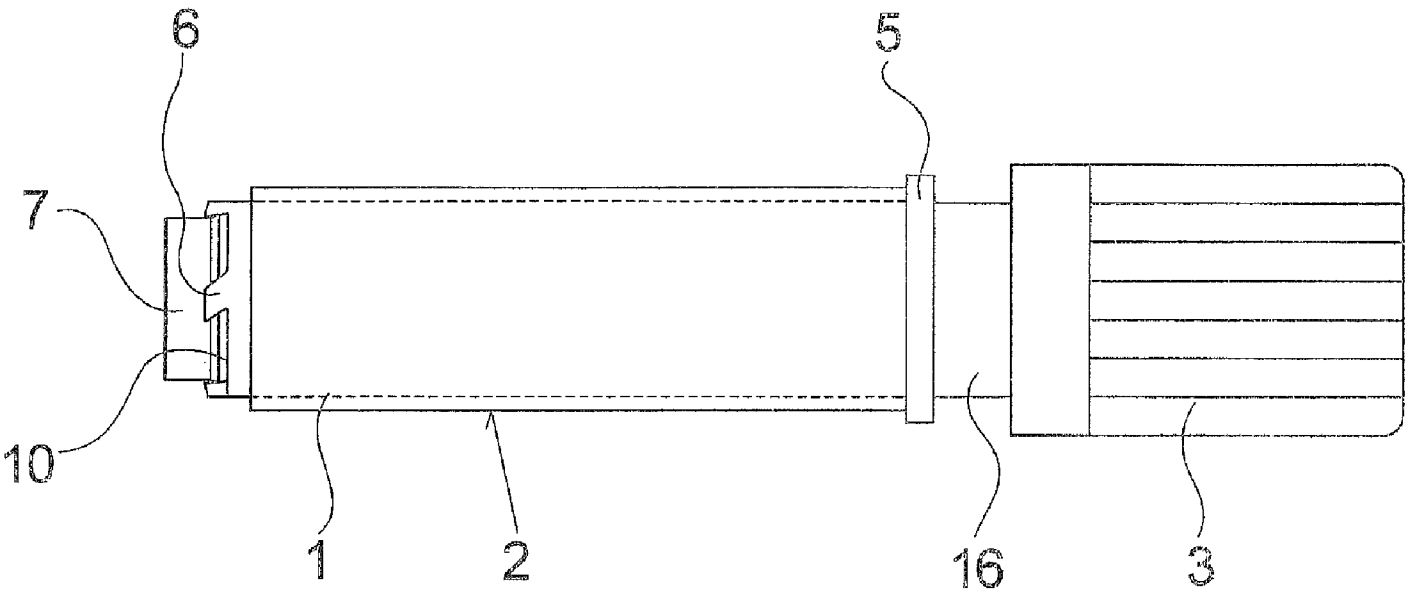

This Patent Application is a Continuation of PCT International Patent Application No. PCT/EP2010/059347 filed on Jul. 1, 2010, entitled "BOBBIN HOLDER", the contents and teachings of which are hereby incorporated by reference in their entirety.

The improvement relates to a bobbin holder for winding a thread.

In the continuous winding of synthetic threads, for example in a melt spinning facility, it is known that the bobbins are wound in alternation by two bobbin holders of a winding machine which are mounted in a movable carrier, and thus are alternatingly guided into a winding region and an exchange region. For the continuous winding of the thread it is provided that when a bobbin is full on one of the bobbin holders, the thread is transferred from the full bobbin of the bobbin holder to an empty bobbin tube of the second bobbin holder. This operation requires that the thread be caught and cut or broken for winding onto the empty bobbin tube or the bobbin holder. This results in a free thread end, which must be fixed on the bobbin tube or on the bobbin holder so as not to jeopardize the new bobbin winding operation.

A bobbin holder is known from DE 103 33 273 A1 in which the thread end is fixed on a bobbin spindle, directly next to the bobbin tube. For this purpose, the bobbin spindle has a thread catching device and thread clamping apparatus. The thread clamping apparatus is formed by a radially movable clamping body which is held against the bobbin spindle in a clamping position as the result of centrifugal force, so that, together with a catch element, fixing of the thread results. It is thus possible to use smooth, unmachined bobbin tubes for holding the bobbins.

Such systems have the basic disadvantage that movable parts at the bobbin spindle inside a thread catching device or as a thread clamping apparatus are continuously subjected to wear. In addition, contaminants, which result from unavoidable thread abrasion, for example, interfere with the centrifugal force-related movability of such clamping bodies. Catch errors are thus possible due to faulty clamping of the thread.

In order to fix a thread outside the bobbin tube directly to a bobbin spindle, another system is known, as described in DE 2 344 377 A1 or DE 93 01 313 U1, for example. In these known bobbin holders, a circumferential radial clamping gap is formed by catch elements and clamping elements at the periphery of the bobbin spindle. After being caught, the thread is drawn into the clamping gap and fixed. To allow the bobbin to be slid off from the bobbin spindle at the end of the bobbin winding operation, the catch element or the clamping element must be movably guided at the periphery of the bobbin spindle so that thread may be released from the clamping gap. This results in the problems, mentioned above, with movable parts of the catching device and of the thread clamping apparatus.

A bobbin holder is known from DE 102 35 209 A1 in which the catching device is formed from a catch bushing having a guide slot, and a guide bushing, concentrically arranged at a distance therefrom, having a guide slot. Between the catch bushing and the guide bushing a clamping device in the form of an elastic ring is provided which is situated between the two bushings to form a clamping gap. The thread is thus fixed between the guide bushing and the elastomer ring. However, such elastic clamping bodies have the basic disadvantage that the clamping forces for fixing the thread diminish over an extended operating period due to the aging characteristics of the clamping bodies. In addition, during the fixing of the thread, the thread may slide back inside the clamping gap formed by the elastic body, which likewise results in catch errors.

The object of the improvement is to provide a bobbin holder of the generic type, in which a thread catching device and a thread clamping apparatus cooperate in such a way that on the one hand secure fixing of the thread on the bobbin spindle, and on the other hand sliding of the bobbin off the bobbin spindle without hindrance, are ensured.

This object is achieved according to the improvement in that the thread clamping apparatus is formed by a hollow cylindrical clamping bushing which via an outer cone is fitted into an inner diameter delimited by the catches of the thread catching device in such a way that a clamping slot which is essentially axially oriented and open toward the slip-on end is formed between the clamping bushing and each catch.

Advantageous refinements of the improvement are defined by the features and feature combinations of the respective subclaims.

Despite the condition that a fixed clamping slot must be used between fixedly mounted parts of the bobbin spindle in order to fix the thread, it has been shown that the axial orientation of the clamping slot allows the thread to be released when the bobbin is slid off. Thus, when the bobbin is slid off, the thread is automatically drawn from the clamping slot, which is open toward the slip-on end.

The improvement also has the particular advantage that very short thread ends are formed as a result of the clamping slot which is provided directly beneath a catch. By drawing the thread into the clamping slot between the catch and the clamping bushing, the thread is directly fixed, resulting in rapid development of tension in the thread. Severing the thread is thus facilitated, so that very short thread ends may be formed.

To produce as little imbalance as possible at the bobbin spindle, according to one advantageous refinement of the improvement the clamping bushing has a circumferential outer cone or multiple cone segments uniformly distributed at the periphery, so that one of multiple clamping slots is associated with each catch.

The design according to the improvement of the clamping slot between the clamping bushing and one of the catches preferably has a V-shaped opening cross section having an opening angle in the range of 1° to 30°. In this way, the thread on the one hand may be quickly and securely fixed, and on the other hand may be released when the bobbin is slid off.

In particular the release and fixing of the thread may be improved in that the clamping slot is formed by two outer cones having different lead angles at the clamping bushing. In this regard, an inlet zone of the clamping slot has an opening angle which is larger than a clamping zone of the clamping slot.

To allow the thread to be accepted from a full bobbin or a manually guided suction gun at the beginning of a bobbin travel, the thread must be caught by the catches of the thread catching device. The thread guiding may be advantageously improved as a result of the refinement of the improvement in which the clamping bushing has a cylindrical guide section, facing the end of the catches, which extends from beneath the catches, beyond the length of the catches. In this way, a thread which is guided at the periphery of the guide section of the clamping bushings may be easily guided for catching beneath the catches, using a suitable guide.

The bobbin holder according to the improvement may also be advantageously used for winding multiple threads in parallel to one another. In this case, in particular the refinement of the improvement is provided in which the bobbin spindle has multiple axially offset thread catching devices and thread clamping apparatuses for accommodating multiple bobbin tubes at the periphery. Each of the thread clamping apparatuses may thus be formed by a clamping bushing, which in each case cooperates with the catches of the thread catching devices.

The improvement is described in greater detail below, based on several example embodiments of the bobbin holder according to the improvement with reference to the accompanying figures.

Figure 2:
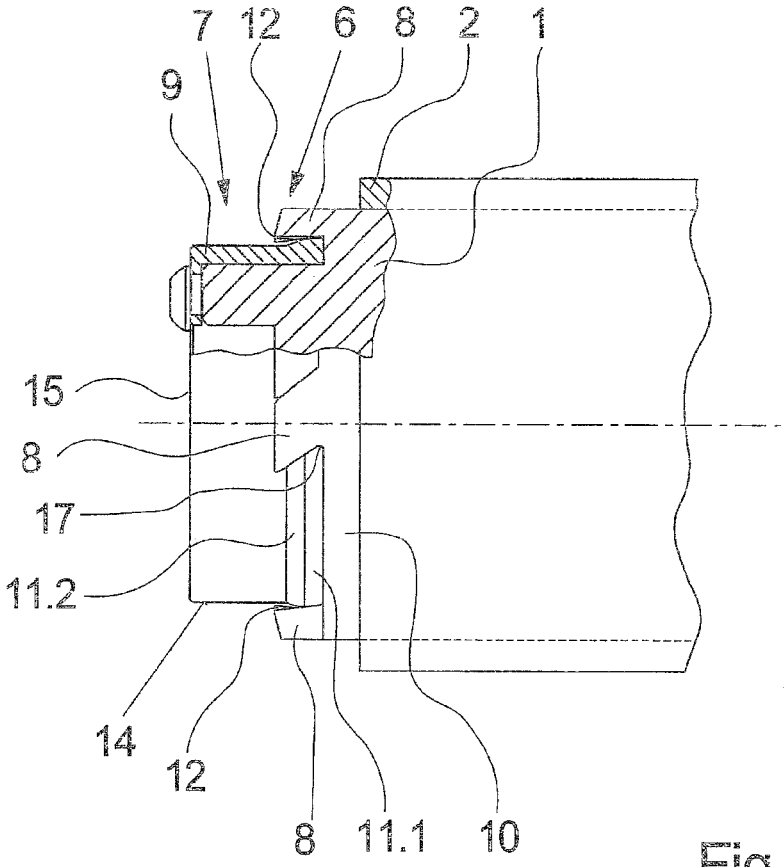
Figure 3:
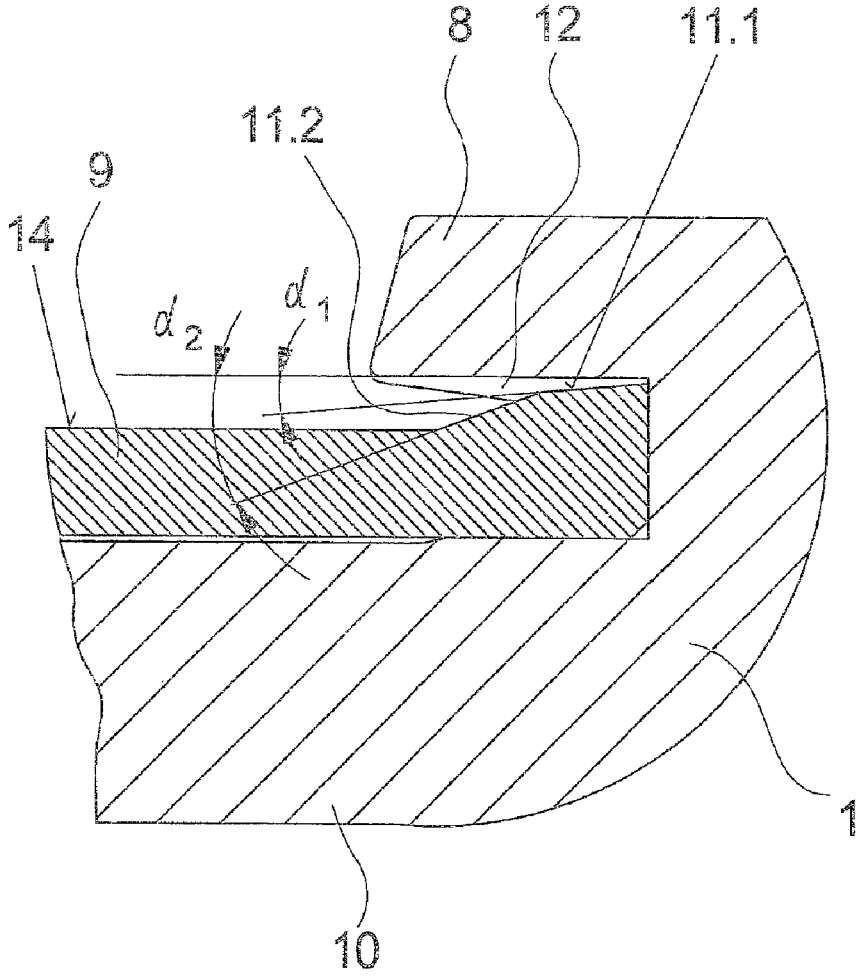
Figure 4:
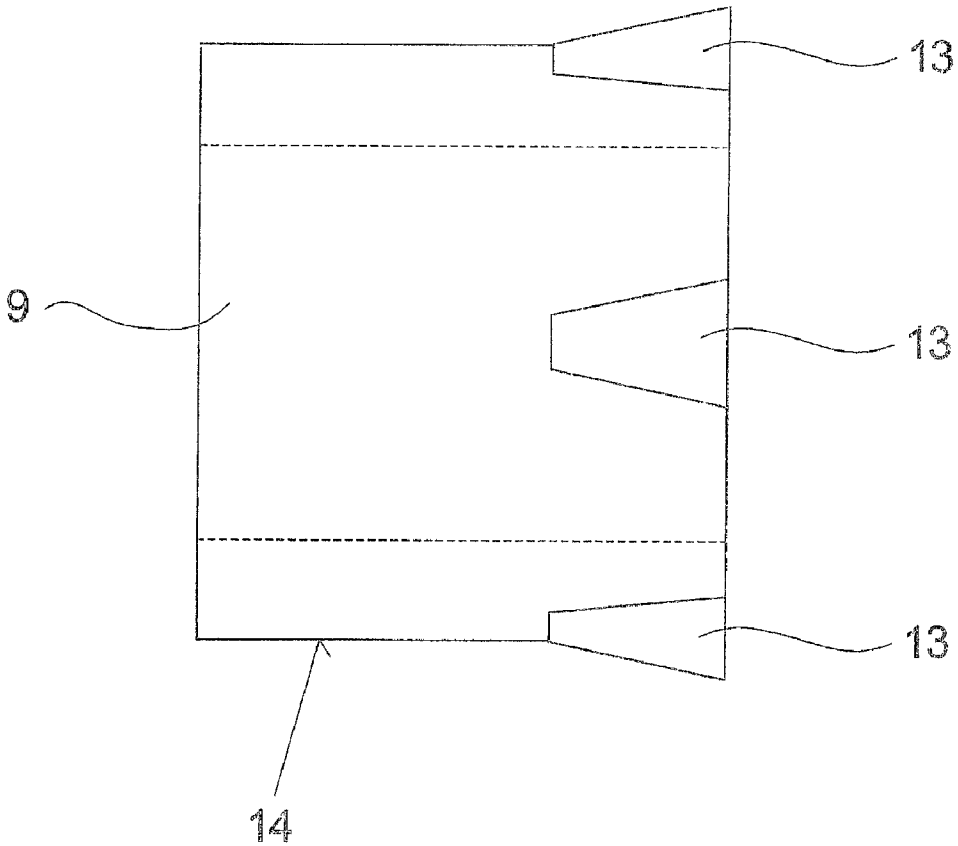
Figure 5:
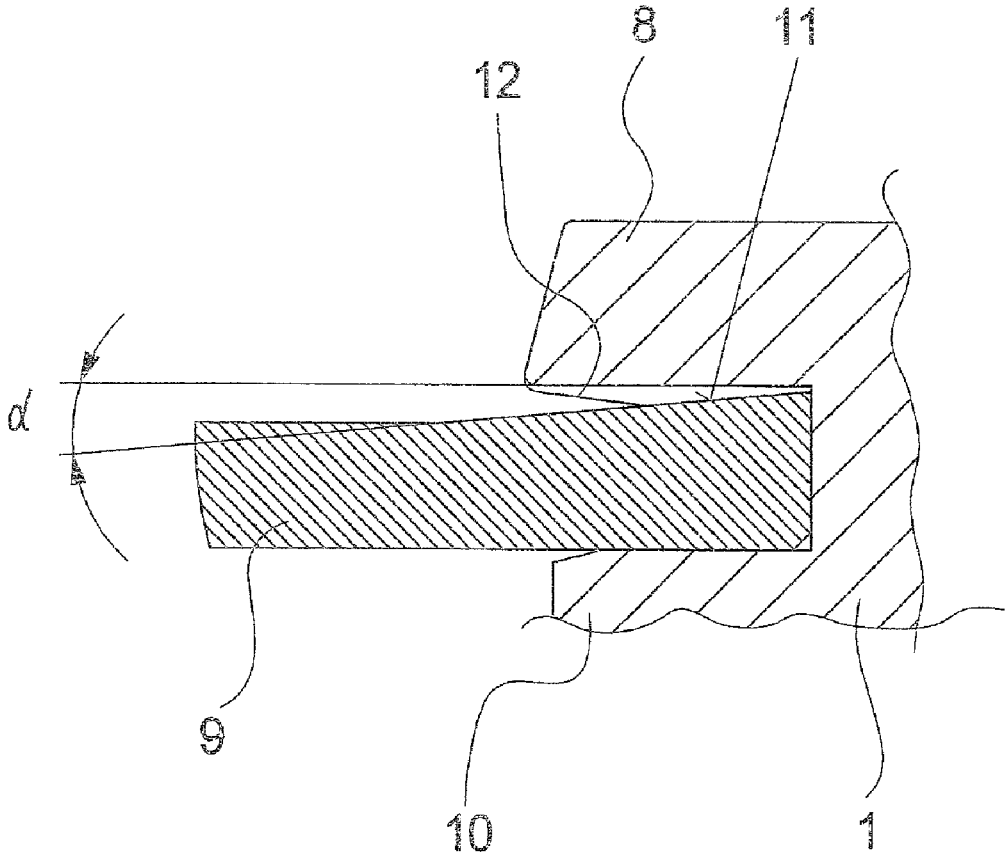
Figure 6:
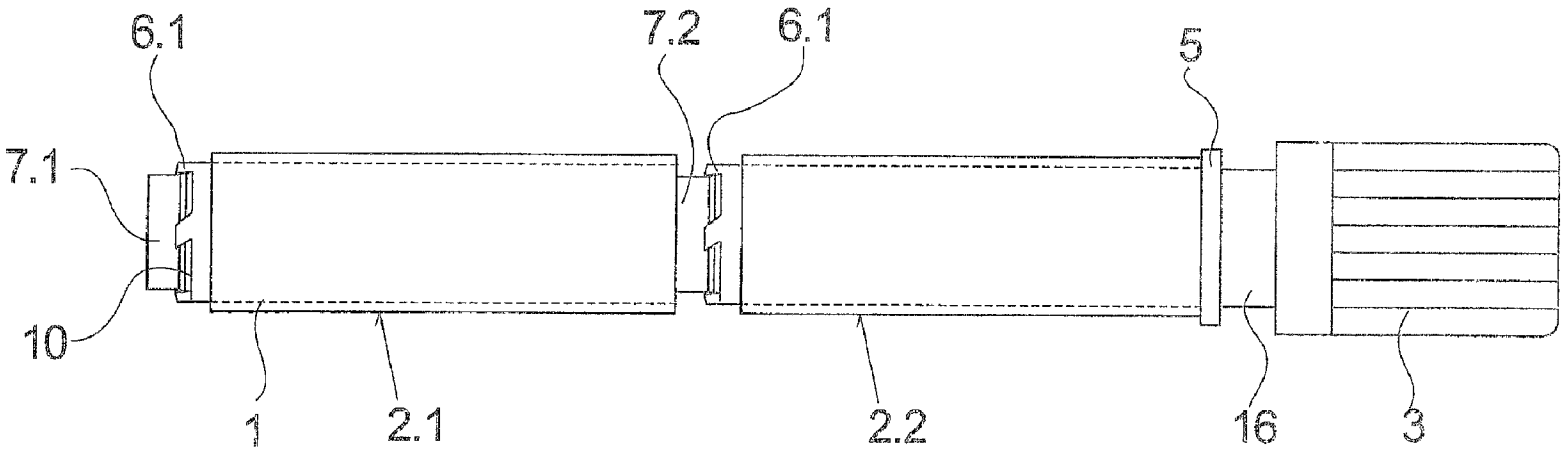

FIG. 1 schematically shows a view of a first example embodiment of the bobbin holder according to the improvement;

FIG. 2 schematically shows a view of the free end of the bobbin spindle from the example embodiment according to FIG. 1;

FIG. 3 schematically shows a cross-sectional view of the clamping slot of the example embodiment from FIGS. 1 and 2;

FIG. 4 schematically shows a view of one example embodiment of a clamping bushing;

FIG. 5 schematically shows a cross-sectional view of a clamping slot at the free end of the bobbin spindle according to the example embodiment corresponding to FIG. 1; and FIG. 6 schematically shows a view of another example embodiment of the bobbin holder according to the improvement.

FIG. 1 schematically shows a first example embodiment of the bobbin holder according to the improvement. The bobbin holder has a projecting bobbin spindle 1 which supports a bobbin tube 2 at its periphery. The bobbin tube 2 is pushed onto the bobbin spindle 1 until reaching a stop 5, and is clamped to the shell of the bobbin spindle 1 by a clamping device (not illustrated here). At a drive end 16 the bobbin spindle 1 is coupled to an electric motor 3. At an opposite slip-on end 10 the bobbin spindle 1 has a thread catching device 6 and a thread clamping apparatus 7.

This type of bobbin holder is usually used in a winding machine in order to wind a continuously running thread into a coil at the periphery of the bobbin tube. Such a bobbin winding machine is known from WO 2007/073860 A1, which is incorporated by reference in its entirety. In such bobbin winding machines, two bobbin holders situated at a distance from one another are mounted on a rotating plate, so that the bobbin holders are guided in alternation into a winding region for winding the thread, and into an exchange region for removing a full bobbin. During the exchange of the bobbin holders, the running thread is transferred from the completely wound bobbin to a bobbin tube.

For this purpose, as shown in FIG. 1 the bobbin holder has the thread catching device 6 and the thread clamping apparatus 7 at the slip-on end 10. For further explanation of the thread catching device 6 and the thread clamping apparatus 7, reference is made to FIG. 2 in the following description.

FIG. 2 schematically illustrates an enlarged view of the slip-on end 10 of the bobbin spindle 1.

In the present example embodiment, the thread catching device 6 is formed by multiple axially protruding catches 8. A total of four catches 8 are uniformly distributed at the periphery of the bobbin spindle 1; in the figures only the catches denoted by reference numeral 8 are visible. The catches 8 are directly situated at the end face of the bobbin spindle 1, the outer diameter formed by the catches 8 being equal to the outer diameter of the bobbin spindle 1. The catches 8 are inclined toward the direction of rotation of the bobbin spindle, thus forming a catch groove 17 between each catch 8 and the end face of the bobbin spindle 1. All of the catches 8 are provided on the bobbin spindle 1 in an identical manner.

At this point it is expressly stated that the bobbin spindle 1 is formed from multiple components which are not explained in greater detail here. Thus, the bobbin spindle 1 supports a clamping device for fixing the bobbin tube 2 on the periphery of the bobbin spindle 1. In addition, a drive shaft which is directly connected to the electric motor is provided inside the bobbin spindle 1. In this regard, it is customary to provide the catches 8 at a bushing which is fixedly connected to the other parts of the bobbin spindle 1 at a slip-on end 10.

The inner sides of the catches 8 surround a clamping bushing 9, which has a hollow cylindrical design and is fixedly connected to the slip-on end 10 of the bobbin spindle 1. The clamping bushing 9 directly adjoins the end face of the bobbin spindle 1, and via an outer cone 11.1 is adapted to an inner diameter, formed by the catches 8, in such a way that a clamping slot 12 is formed between the outer cone 11.1 and each catch 8. The outer cone 11.1 is provided circumferentially at the end of the clamping bushing 9, and for each catch 8 thus produces a clamping slot 12 situated directly beneath each catch 8. Thus, in the present example embodiment four catches 8 having four associated clamping slots 12 are situated at the periphery of the bobbin spindle 1.

Reference is made to FIG. 3 for the further explanation of the clamping slot 12 between each catch 8 and the clamping bushing 9. FIG. 3 illustrates an enlarged cross-sectional view of a catch 8 together with a clamping slot 12. In the present example embodiment, the clamping slot 12 is formed by two outer cones 11.1 and 11.2 of the clamping bushing 9 which merge into one another. A first section of the clamping slot 12 has an opening cross section, having an opening angle $\alpha_1$, which is specified by the outer cone 11.1. This section of the clamping slot 12 is referred to here as a clamping zone. A second directly adjoining region of the clamping slot is formed by the second outer cone 11.2, and has a much larger opening cross section having an opening angle $\alpha_2$. This section of the clamping slot 12 is referred to as the inlet zone. The clamping slot 12 thus extends in the axial direction of the bobbin spindle 1, and is open toward the slip-on end 10. The embodiment of the clamping slot 12 is particularly advantageous for automatically releasing the thread end, which is fixed in the clamping slot 12, when a bobbin is slid off the bobbin spindle 1. The axial orientation of the clamping slot 12 as well as the larger opening angle $\alpha_2$ of the inlet zone of the clamping slot 12 facilitate the release of the thread end when a bobbin is slid off. Quick and reliable fixing of the thread after catching by each catch 8 is guaranteed in particular by the clamping zone of the clamping slot 12, which has a smaller angle $\alpha_1$. Thus, the opening angle $\alpha_1$ is preferably in a range of 1° to 15°. In contrast, the opening angle $\alpha_2$ in the inlet zone is in a range of 10° to 30°.

It is noted from the illustration in FIG. 2 that the clamping bushing 9 has a cup-shaped design, with the outer cone 11.1 situated at the free end of the clamping bushing 9. The clamping bushing 9 is screwed directly to the bobbin spindle 1 through an end face 15. The clamping bushing 9 thus forms a guide section 14 which extends from beneath the catches 8, beyond the free end of the catches 8. As a result of the cones 11.1 and 11.2, the guide section 14 of the clamping bushing 9 has a smaller outer diameter than the inner region of the catches 8. The guide section 14 of the clamping bushing 9 may thus be advantageously used to guide a thread beneath the catches 8, using a guide.

Such guides are known, for example, from the bobbin winding machine as described in the document WO 2007/

073860. In this regard, explicit reference is made to the cited document for explaining the function and design of such guides.

In the example embodiment illustrated in FIG. 1, it is essential that the thread catching device 6 and the thread clamping apparatus 7 have a rotationally symmetrical design at the slip-on end 10 of the bobbin spindle 1. Imbalance at the bobbin spindle 1 may thus be avoided, so that such bobbin spindles are suitable in particular for high winding speeds. Accordingly, the four catches 8 of the thread catching device 6 are uniformly distributed at the periphery of the bobbin spindle 1.

The outer cone of the clamping bushing 9 for forming the clamping slots 12 could also have a segmented design at the periphery of a clamping bushing 9. Such a clamping bushing is schematically illustrated in FIG. 4, for example.

In the clamping bushing 9 illustrated in FIG. 4, multiple cone segments 13 are provided at one end of the clamping bushing, uniformly distributed at the periphery of the clamping bushing 9. The number and location of the cone segments 13 are identical to the number and location of the catches 8 of the thread catching device 6 provided at the slip-on end 10 of the bobbin spindle 1. This results in one clamping slot 12 for each catch 8, corresponding to the shapes of the cone segments 13.

To this end, FIG. 5 shows the clamping slot 12 formed by the clamping bushing 9 illustrated in FIG. 4. In this example embodiment, the clamping slot 12 is formed by a cone 11, resulting in a uniform opening angle $\alpha$. Such opening angles $\alpha$ are in a range between 1° and 30°, depending on the type of thread that is to be wound into a coil.

The thread catching device 6 and thread clamping apparatus 7 described for the example embodiment according to FIG. 1 are also suited in principle for catching and fixing a thread at any desired location on the bobbin spindle. Thus, FIG. 6 shows one example embodiment of a bobbin holder in which a bobbin spindle 1 holds multiple bobbin tubes 2.1 and 2.2 next to one another in the axial direction in order to wind a thread into a coil at each of the bobbin tubes 2.1 and 2.2. At its drive end 16 the bobbin spindle 1 is connected to an electric motor 3. A thread catching device 6.1 and 6.2 as well as a thread clamping apparatus 7.1 and 7.2 are respectively situated at the periphery of the bobbin spindle 1, in a region between the bobbin tubes 2.1 and 2.2, and at a slip-on end 10. The thread catching devices 6.1 and 6.2 as well as the thread clamping apparatus 7.1 and 7.2 are formed by multiple catches and a clamping bushing, as previously described. The clamping bushing in the center region of the bobbin spindle has a continuous hollow cylindrical design.

The design and functioning principle of the clamping slots are identical to the above-mentioned example embodiment, and therefore are not further described here.

The bobbin holder according to the improvement is thus particularly suited for fixing a thread end at the periphery of the bobbin spindle at the beginning of a bobbin travel. Thus, smooth, unmachined bobbin tubes without any catch notches may be used.

LIST OF REFERENCE NUMERALS

| | |
|---|---|
| 1 | Bobbin spindle |
| 2, 2.1, 2.2 | Bobbin tube |
| 3 | Electric motor |
| 4 | Bobbin tube |
| 5 | Stop |
| 6, 6.1, 6.2 | Thread catching device |
| 7, 7.1, 7.2 | Thread clamping apparatus or means |
| 8 | Catch |
| 9 | Clamping bushing |
| 10 | Slip-on end |
| 11, 11.1, 11.2 | Outer cone |
| 12 | Clamping slot |
| 13 | Cone segment |
| 14 | Guide section |
| 15 | End face |
| 16 | Drive end |
| 17 | Catch groove |

The invention claimed is:

1. Bobbin holder for winding a thread, having a projecting bobbin spindle for sliding into a bobbin tube, the bobbin spindle having a thread catching device and a thread clamping apparatus at a free slip-on end, the thread catching device being formed by multiple axially protruding catches which cooperate with the thread clamping apparatus for clamping the thread at the beginning of a bobbin travel, wherein the thread clamping apparatus is formed by a hollow cylindrical clamping bushing which via an outer cone is fitted into an inner diameter delimited by the catches in such a way that a fixed clamping slot which is essentially axially oriented and open toward the slip-on end is formed between the clamping bushing and the catch.

2. Bobbin holder according to claim 1, wherein the clamping bushing has multiple cone segments uniformly distributed at the periphery, so that one of multiple clamping slots is associated with each catch.

3. Bobbin holder according to claim 1, wherein the clamping slot between the clamping bushing and one of the catches has a V-shaped opening cross section having an opening angle ($\alpha$) in the range of 1° to 30°.

4. Bobbin holder according to claim 1, wherein the clamping slot is formed by two outer cones having different lead angles at the clamping bushing, an inlet zone of the clamping slot having an opening angle ($\alpha_2$) which is larger than a clamping zone of the clamping slot, having an opening angle ($\alpha_1$).

5. Bobbin holder according to claim 1, wherein the clamping bushing has a cylindrical guide section, facing the end of the catches, which extends from beneath the catch, beyond the length of the catches.

6. Bobbin holder according to claim 1, wherein the bobbin spindle has multiple axially offset thread catching devices and thread clamping apparatus for accommodating multiple bobbin tubes at the periphery.

7. Bobbin holder according to claim 1, wherein the clamping bushing at the end of the bobbin spindle has a cup-shaped design, and is attached to the bobbin spindle at an end face.

8. Bobbin holder according to claim 7, wherein additional outer cones are provided at the open end of the clamping bushing.

9. Bobbin holder according to claim 1, wherein the bobbin spindle is connected to an electric motor at the oppositely situated drive end.

* * * * *